US007270561B2

(12) United States Patent
Chiu

(10) Patent No.: US 7,270,561 B2
(45) Date of Patent: Sep. 18, 2007

(54) LAMP ARM FIXING DEVICE OF A JUNCTION BOX FOR A PENDENT LAMP

(76) Inventor: Jui-Chung Chiu, No. 192, San Lung St., Shulin City, Taipei Hsien (TW)

( * ) Notice: Subject to any disclaimer, the term of this patent is extended or adjusted under 35 U.S.C. 154(b) by 198 days.

(21) Appl. No.: 11/241,114

(22) Filed: Sep. 29, 2005

(65) Prior Publication Data

US 2007/0041203 A1 Feb. 22, 2007

(30) Foreign Application Priority Data

Aug. 17, 2005 (TW) ..... 94214103 U

(51) Int. Cl.
*H01R 13/627* (2006.01)

(52) U.S. Cl. ..... 439/357; 439/253; 439/551

(58) Field of Classification Search ..... 439/253, 439/357, 356, 350, 351, 551
See application file for complete search history.

(56) References Cited

U.S. PATENT DOCUMENTS 6,514,099 B2 * 2/2003 Endo ..... 439/489

* cited by examiner

*Primary Examiner*—Javaid H. Nasri
(74) *Attorney, Agent, or Firm*—Pro-Techtor Int'l Services

(57) ABSTRACT

A lamp arm fixing device of a junction box for a pendent lamp includes a lamp holder and a connection housing. When the connection housing is completely inserted in the lamp holder, the engaging plate of the lamp holder engages the positioning screw portion at one end of the connection housing whereby the connection housing is secured in the receiving hole of the lamp holder. The connection housing is defined with an open slot. A slide slot extends from an end of the open slot whereby when the connection housing is inserted in the lamp holder, the open slot is inserted in a direction facing the screw of the lamp holder and the screw extends through the open slot and is positioned in the slide slot. Thus, the female connector received in the connection housing is mated with the male connector received in the lamp holder in a proper direction.

6 Claims, 4 Drawing Sheets

LAMP ARM FIXING DEVICE OF A JUNCTION BOX FOR A PENDENT LAMP

RELATED APPLICATIONS

The present application is based on, and claims priority from, Taiwan Application Serial Number 94214103, filed Aug. 17, 2005, the disclosure of which is hereby incorporated by reference herein in its entirety.

FIELD OF THE INVENTION

This present invention relates to a lamp arm fixing device of a junction box for a pendent lamp, and particularly to a lamp arm fixing device which can readily assemble or disassemble a lamp arm.

BACKGROUND OF THE INVENTION

A conventional junction box for a pendent lamp is generally integrally formed with a lamp arm or connected with a lamp arm through soldering. However, this results in overlarge volume of the pendent lamp package which requires large space for storage and transportation. Therefore, it is unnecessarily costly and inconvenient for a user to purchase and install by himself.

In order to facilitate packing and transporting the pendent lamp, the lamp arm and the junction box are configured to be separable. For example, the lamp arm is connected with the junction box through bolts and nuts. Thus, the lamp arm may be disassembled such that its package volume is reduced.

However, the conventional lamp arm is assembled to the junction box using tools, which makes assembling or disassembling the lamp arm and the junction box troublesome and inconvenient. Furthermore, a male connector is inserted into a female connector for achieving electrical connection when the lamp arm is assembled to the junction box. The union of the male and female connectors includes positioning the male connector relative to the female connector, which makes the connection operation complicated.

SUMMARY OF THE INVENTION

A main object of the present invention is to provide a lamp arm fixing device of a junction box for a pendent lamp which simply assembles a lamp arm to the junction box and reduces package volume.

Another object of the present invention is to provide a lamp arm fixing device of a junction box for a pendent lamp which has a lamp holder and a connection housing with a positioning structure disposed between the lamp holder and the connection housing so as to facilitate assembling the connection housing to the lamp holder.

To achieve the above objects, the present invention provides a lamp arm fixing device of a junction box for a pendent lamp. The lamp arm fixing device is received in the junction box which has a sidewall with at least one through-hole being defined therein. The lamp arm fixing device includes a lamp holder and a connection housing. The lamp holder has a receiving tube at one side thereof. A receiving hole is defined along the axial center of the receiving tube. A thread portion is disposed at the outer surface of the receiving tube. The receiving tube extends from the inside of the junction box and is fixed in the through-hole, thereby positioning the lamp holder at the inner side of the through-hole of the junction box. The lamp holder has a fixing portion at the other side thereof. A fixing recess is defined along the center of the fixing portion. The fixing recess is in communication with the receiving hole. The fixing portion sidewall is symmetrically disposed with a plurality of through apertures which extend into the inside of the fixing recess. The lamp holder has a stop resilient plate which has a pair of symmetrically bent engaging plates positioned in the through apertures and extending into the receiving hole. One end surface of the lamp holder is defined with a screw hole. The screw hole and the receiving hole are in communication with each other. A screw is threaded in the screw hole with a distal end extending into the receiving hole. The connection housing is a hollow tube and is inserted into the receiving hole of the receiving tube. One end of the connection housing is annularly disposed with a flange and is defined with a shaft hole. The other end of the connection housing is disposed with a positioning screw portion at the outer surface thereof and is defined with a receiving slot at the center thereof. The receiving slot receives a female connector therein. Two open slots are defined in the side surface of the connection housing corresponding to the opposite sides of the receiving slot. A slide slot extends from one end of one of the open slots. When one end of the connection housing is inserted into the receiving hole of the receiving tube, the distal end of the screw extends through the open slot and then positioned in the slide slot whereby the connection housing is inserted in the receiving hole only in one fixing direction and the female connector is mated with the male connector. The engaging plates of the stop resilient plate engage with the positioning screw portion of the connection housing whereby the connection housing is stably secured in the lamp holder.

These and other embodiments, aspects and features of the invention will be better understood from a detailed description of the preferred embodiment of the invention, which is further described below in conjunction with the accompanying figures.

DETAILED DESCRIPTION OF THE PREFERRED EMBODIMENT

Figure 1:
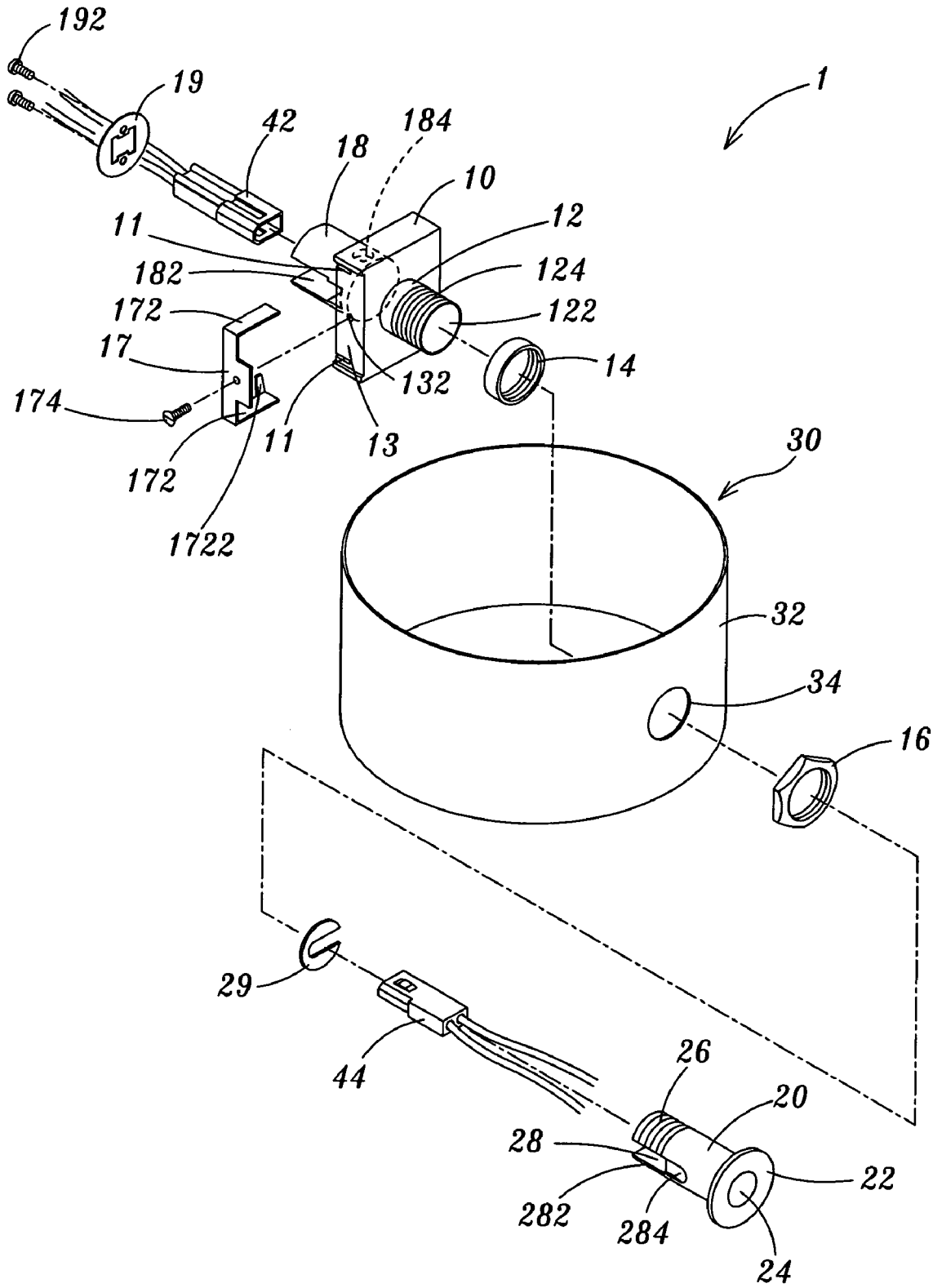
FIG. 1 is a perspective exploded view of a lamp arm fixing device of a junction box for a pendent lamp of the present invention.
Figure 2:
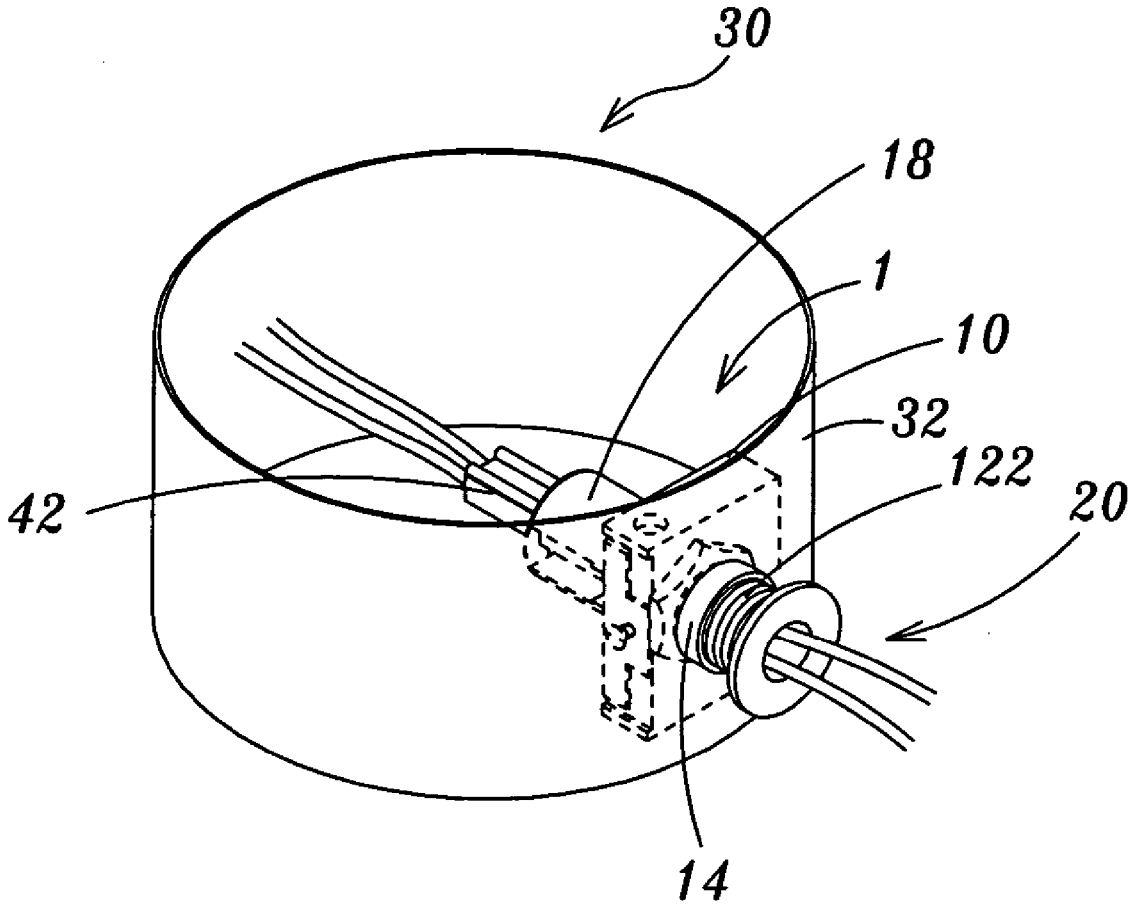
FIG. 2 is an assembled view of the FIG. 1.

Referring to FIGS. 1 and 2, a lamp arm fixing device 1 of the present invention includes a lamp holder 10 and a connection housing 20. The lamp arm fixing device 1 is received in a junction box 30.

The junction box 30 has a sidewall 32 with at least one through-hole 34 being defined in the sidewall 32.

The lamp holder 10 has a receiving tube 12 at one side thereof. A receiving hole 122 is defined along the axial center of the receiving tube 12. A thread portion 124 is disposed at the outer surface of the receiving tube 12. The receiving tube 12 extends from the inside of the junction box 30 through the through-hole 34. The thread portion 124 of the receiving tube 12 respectively at the inside and outside of the junction box 30 respectively threaded with a positioning ring 14 and an adjustment nut 16 thereby fixing the lamp holder 10 at the inside of the junction box 30. The lamp holder 10 has a fixing portion 18 at the other side thereof. A fixing recess 182 is defined in the center of the fixing portion 18 and in communication with the receiving hole 122. A male connector 42 is engaged inside the fixing recess 182. A locking plate 19 is disposed at the fixing recess 182, receiving the male connector 42 and fixed to the fixing portion 18 through a plurality of screws 192. A plurality of through apertures 184 is respectively symmetrically defined in the sidewall of the fixing portion 18 and extends through the inside of the fixing recess 182.

The lamp holder 10 additionally has a stop resilient plate 17. The stop resilient plate 17 is a C-shaped frame and has two opposite side plates 172 which are generally parallel to each other. Two symmetrically bent engaging plates 1722 respectively extend from outer edges of distal ends of the opposite side plates 172 and are positioned inside the through apertures 184. Additionally, a plurality of engaging slots 11 is defined in the side surface of the lamp holder 10 corresponding to the through apertures 184 of the fixing portion 18 for engaging with the stop resilient plate 17. In addition, a screw hole 132 is defined in one end surface 13 of the lamp holder 10. The screw hole 132 is in communication with the receiving hole 122, thereby fixing the stop resilient plate 17 at the end surface 13 through a screw 174 and projecting the distal end of the screw 174 into the inside of the receiving hole 122.

Figure 4:
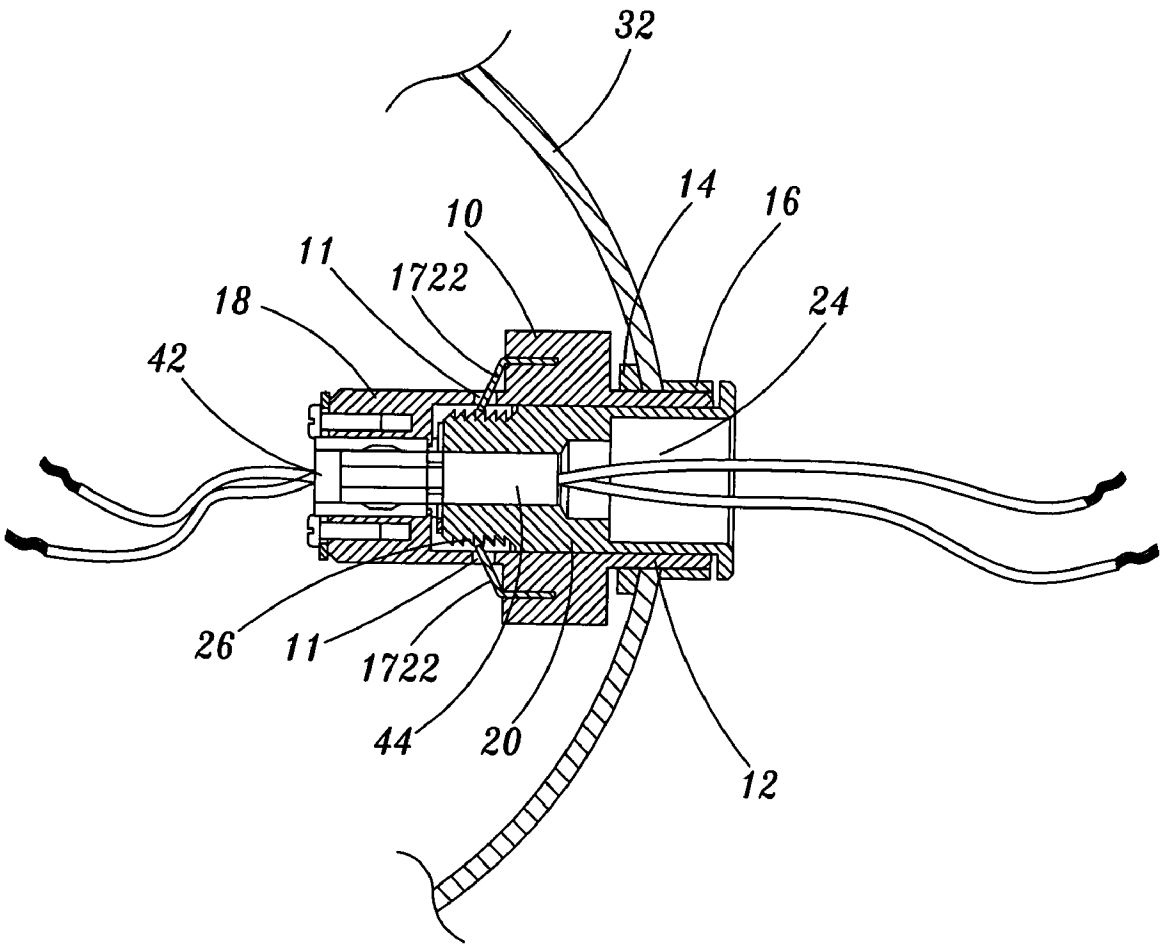
FIG. 4 is a cross-sectional view showing a connection housing being connected to a lamp holder in accordance with a lamp arm fixing device of a junction box for a pendent lamp of the present invention.

Including reference to FIG. 4, the connection housing 20 is a hollow tube and is received in the receiving hole 122 of the receiving tube 12. One end of the connection housing 20 is annularly disposed with a flange 22. A shaft hole 24 is defined in the end of the connection housing 20 for providing insertion of a lamp arm (not shown) of a pendent lamp. The other end of the connection housing 20 is disposed with a positioning screw portion 26 at the outer surface thereof. A receiving slot 28 is defined in the center of the other end of the connection housing 20. A female connector 44 is received in the receiving slot 28. A fixing plate 29 is attached to the female connector 44 for fixing the female connector 44 at the other end of the connection housing 20. The connection housing 20 is defined with two open slots 282 in the side surface thereof corresponding to opposite sides of the receiving slot 28. A slide slot 284 extends from the distal end of one open slot 282 whereby when the end of the connection housing 20 receiving the female connector 44 inserts into the receiving hole 122 of the receiving tube 12, the distal end of the screw 174 of the lamp holder 10 extends through the open slot 282 and then is positioned in the slide slot 284. Thus, the connection housing 20 can only be inserted into the receiving hole 122 at one fixing position, thereby achieving positioning effect. Therefore, when the connection housing 20 is inserted into the receiving hole 122, the female connector 44 can be mated with the male connector 42. When the connection housing 20 is inserted in the receiving hole 122, the engaging plates 1722 of the stop resilient plate 17 engage with the positioning screw portion 26 disposed at the other end of the connection housing 20 whereby the connection housing 20 is stably engaged with the lamp holder 10.

Figure 3:
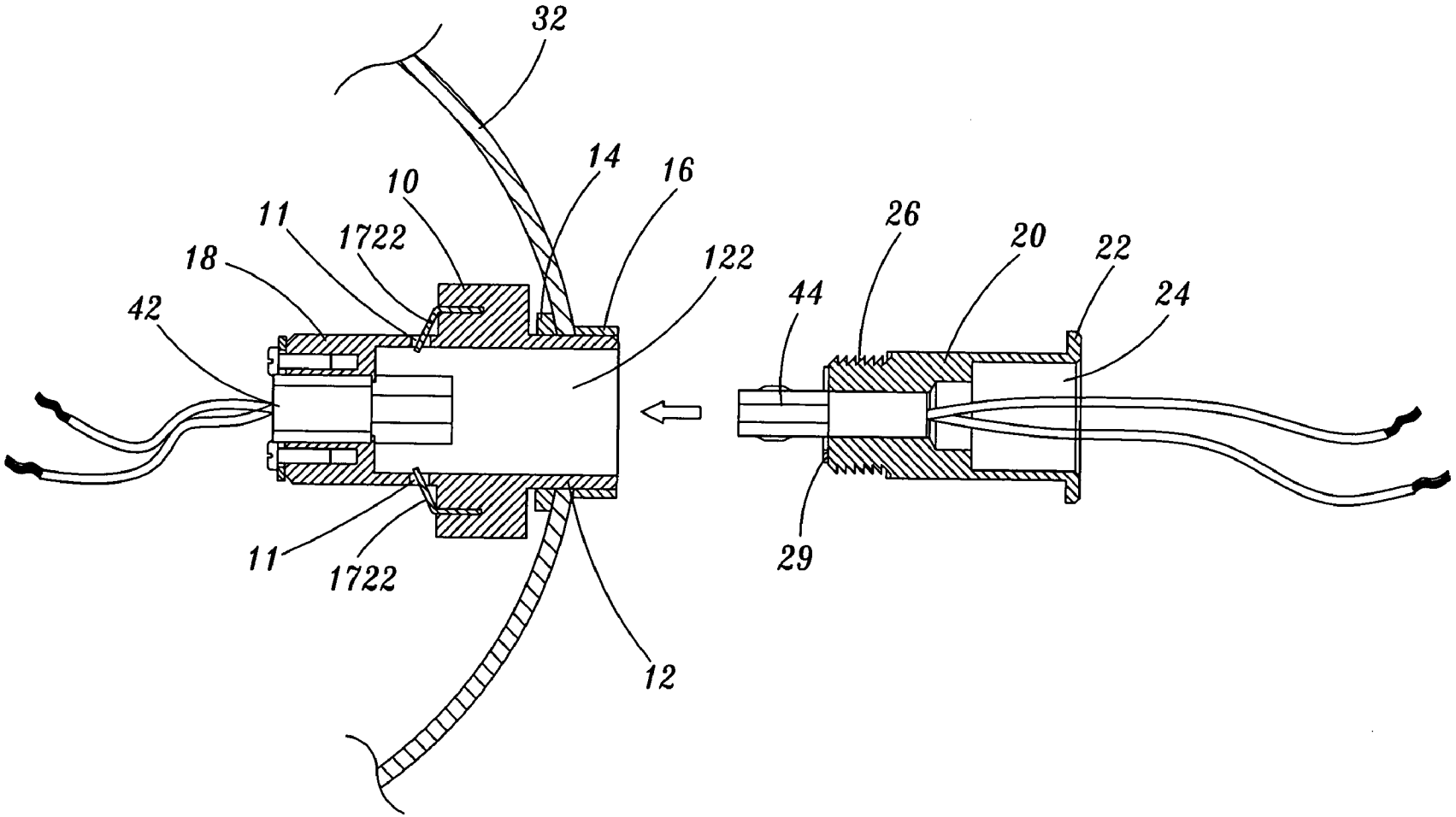
FIG. 3 is a cross-sectional view showing a connection housing to connect a lamp holder in accordance with a lamp arm fixing device of a junction box for a pendent lamp of the present invention.

Referring to FIGS. 3 and 4, when the connection housing 20 of the present invention is inserted into the receiving hole 122 of the receiving tube 12 of the lamp holder 10, the end of the connection housing 20 having the female connector 44 extends into the receiving hole 122 and pushes the engaging plates 1722 to bend upward. When the connection housing 20 is completely inserted in the lamp holder 10, the engaging plates 1722 engage with the positioning screw portion 26 at one end of the connection housing 20, thereby securing the connection housing 20 in the receiving hole 122. Furthermore, in order to position the connection housing 20 in the receiving hole 122 along a proper direction, the present invention provides one open slot 282 disposed at the connection housing 20 with the slide slot 284 extending from the open slot 282 whereby when the connection housing 20 is inserted into the receiving hole 122, the open slot 282 having the slide slot 284 is faced to the screw hole 132 and then is inserted. Therefore, the distal end of the screw 174 extends through the open slot 282 and then is positioned in the slide slot 284. At the same time, the female connector 44 received in the connection housing 20 is mated with the male connector 42 received in the lamp holder 10 in a proper direction.

It is known from the above description that the present invention enables the lamp holder 10 and the connection housing 20 to be easily and safely disassembled and assembled. Furthermore, the lamp arm inserted in the connection housing 20 is disassembled and assembled by a user, thereby reducing the volume of the pendent lamp packaging and facilitating installing and using the pendent lamp.

The preferred embodiment, aspects, and features of the invention have been described in detail. It will be apparent to those skilled in the art that numerous variations, modifications, and substitutions may be made without departing from the spirit of the invention as disclosed and further claimed below.

What is claimed is:

1. A lamp arm fixing device of a junction box for a pendent lamp, received in the junction box which has a sidewall with at least one through-hole being defined therein, the lamp arm fixing device comprising:

a lamp holder, wherein the lamp holder has a receiving tube at one side thereof, a receiving hole is defined along the axial center of the receiving tube, a thread portion is disposed at the outer surface of the receiving tube, the receiving tube extends from the inside of the junction box and is fixed in the through-hole, thereby positioning the lamp holder at the inner side of the through-hole of the junction box; the lamp holder has a fixing portion at the other side thereof, a fixing recess is defined along the center of the fixing portion, the fixing recess is in communication with the receiving hole, a fixing portion sidewall is symmetrically disposed with a plurality of through apertures which extend into the inside of the fixing recess; the lamp holder has a stop resilient plate which has a pair of symmetrically bent engaging plates positioned in the through apertures and extending into the receiving hole; one end surface of the lamp holder is defined with a screw hole, the screw hole and the receiving hole are in communication with each other, a screw is threaded in the screw hole with a distal end extending into the receiving hole; and a connection housing, wherein the connection housing is a hollow tube and is inserted into the receiving hole of the receiving tube, one end of the connection housing is annularly disposed with a flange and is defined with a shaft hole, the other end of the connection housing is disposed with a positioning screw portion at the outer surface thereof and is defined with a receiving slot at the center thereof, the receiving slot receives a female connector therein, two open slots are defined in the side surface of the connection housing corresponding to the opposite sides of the receiving slot, a slide slot extends from one end of one of the open slots, wherein when one end of the connection housing is inserted into the receiving hole of the receiving tube, the distal end of the screw extends through the open slot and is then positioned in the slide slot whereby the connection housing is inserted in the receiving hole only in one fixing direction and the female connector is mated with a male connector, and the engaging plates of the stop resilient plate engage with the positioning screw portion of the connection housing whereby the connection housing is stably secured in the lamp holder.

2. The lamp arm fixing device of claim 1, wherein the thread portion of the receiving tube locates at the inner side and outer side of the junction box and respectively threads with a positioning ring and an adjustment nut, thereby locking the lamp holder in the junction box.

3. The lamp arm fixing device of claim 1, wherein a locking plate is connected to the male connector and is fixed at one end of the fixing portion through a plurality of screws.

4. The lamp arm fixing device of claim 1, wherein the stop resilient plate is a C-shaped frame with two opposite side plates being parallelly disposed, a bent engaging plate extends from each of outer edges of the opposite side plates, and the side surface of the lamp holder corresponding to the through apertures of the fixing portion is defined with a plurality of engaging slots for fixing the stop resilient plate.

5. The lamp arm fixing device of claim 4, wherein the screw threads into the stop resilient plate at the lamp holder with the distal end thereof extending into the receiving hole.

6. The lamp arm fixing device of claim 1, wherein the female connector is connected with a fixing plate for fixing the female connector at one end of the connection housing.

* * * * *